United States Patent [19]

Ohm

[11] 4,364,052

[45] Dec. 14, 1982

[54] ANTENNA ARRANGEMENTS FOR SUPPRESSING SELECTED SIDELOBES

[75] Inventor: Edward A. Ohm, Holmdel, N.J.

[73] Assignee: Bell Telephone Laboratories, Incorporated, Murray Hill, N.J.

[21] Appl. No.: 201,816

[22] Filed: Oct. 29, 1980

[51] Int. Cl.[3] ..... H01Q 19/14

[52] U.S. Cl. ..... 343/781 P; 343/840; 343/781 CA

[58] Field of Search ..... 343/100 LE, 100 PE, 343/781 CA, 781 P, 781 R, 840, 776–779

[56] References Cited

U.S. PATENT DOCUMENTS

| | | | |
|---|---|---|---|
| 2,718,592 | 9/1955 | Smith | 250/33.63 |
| 3,094,695 | 6/1963 | Jahn | 343/100 |
| 3,160,887 | 12/1964 | Broussaud et al. | 343/777 |
| 3,176,301 | 3/1965 | Wellons et al. | 343/782 |
| 3,202,990 | 8/1965 | Howells | 343/100 |
| 3,325,816 | 6/1967 | Dutton | 343/777 |
| 3,633,208 | 1/1972 | Ajioka | 343/778 |
| 3,704,464 | 11/1972 | Drane, Jr. et al. | 343/100 |
| 3,811,129 | 5/1974 | Holst | 343/844 |
| 3,815,140 | 6/1974 | Buehler et al. | 343/779 |
| 4,051,474 | 9/1977 | Mack et al. | 343/100 LE |

*Primary Examiner*—David K. Moore
*Attorney, Agent, or Firm*—Erwin W. Pfeifle

[57] ABSTRACT

The present invention relates to an antenna arrangement for suppressing selected sidelobes where the arrangement comprises a main focusing reflector (10), a main feed arrangement (14) and at least two auxiliary feed arrangements (20 and 21) disposed on opposite sides of, and a predetermined equal distance from, the main feed arrangement in the plane of the sidelobes to be suppressed. All feed arrangements radiate the same signal and their individual beams are radiated in a direction whereby the central ray thereof impinge the same point on the main reflector. By proper adjustment of the phase, amplitude and transverse off-axis distance of the auxiliary feed arrangements from the main feed arrangement, the combined E-field distribution of the auxiliary feed arrangements at the edge of the reflector in the plane of the sidelobes to be suppressed will be equal and opposite to the E-field distribution of the main feed arrangement. Additional auxiliary feed arrangements or clusters of auxiliary feed elements may also be employed for far and near sidelobe suppression.

6 Claims, 5 Drawing Figures

ANTENNA ARRANGEMENTS FOR SUPPRESSING SELECTED SIDELOBES

BACKGROUND OF THE INVENTION

1. Field of the Invention

The present invention relates to antenna arrangements for suppressing selected sidelobes and, more particularly, to antenna arrangements comprising a focusing reflector, a main feed arrangement and at least two auxiliary feed arrangements disposed on opposite sides of, and a predetermined equal distance from, the main feed arrangement in the plane of the selected sidelobes to be primarily suppressed. By proper adjustment of the phase, amplitude, direction and transverse off-axis distance of the auxiliary feed arrangement with respect to the main feed arrangement, the selected sidelobes will be suppressed.

2. Description of the Prior Art

In radar systems and in terrestrial and satellite communication systems, various techniques have been used to reduce certain sidelobes and in turn the interference therefrom in adjacent links. In receiving systems, undesired sidelobe signals are generally suppressed by receiving the desired signal at a directional antenna and possible interfering signals at a separate omnidirectional antenna. The derived interfering signals are then used to cancel interference in the desired signal using various circuitry configurations. In this regard see, for example, U.S. Pat Nos. 3,094,695 issued to D. M. Jahn on June 18, 1963 and 3,202,990 issued to P. W. Howells on Aug. 24, 1965.

Alternatively, for transmission purposes U.S. Pat. No. 3,704,464 issued to C. J. Drane, Jr. et al on Nov. 28, 1972 discloses a method for maximizing aerial directive gain while simultaneously placing nulls in the far-field radiation pattern of an array of N elements which are arbitrarily positioned. The patented method permits specification of directions of up to N-1 independent pattern nulls and/or sidelobes while assertedly providing maximum gain in some prescribed direction. This control is apparently achieved by varying only the amplitude and phase of the element currents in association with a standard gain formula.

U.S. Pat. No. 3,815,140 issued to W. E. Buehler et al on June 4, 1974 relates to a multiple feed arrangement for microwave parabolic antennas which include a parabolic reflector, and a plurality of individually fed illuminators. Each illuminator alone produces a beam of certain dimensions, and by combining the beams through the use of a predetermined configuration of illuminators, including their number and spacing, the physical configuration of the beam, including sidelobes, may be accurately controlled. Furthermore, certain illuminators may be fed by different information sources, thus resulting in a multiple information beam pattern.

The problem remaining in the prior art is to be able to provide antenna arrangements which produce low sidelobes in selected directions to provide minimal interference in certain links using simple techniques.

SUMMARY OF THE INVENTION

The foregoing problem has been solved in accordance with the present invention which relates to antenna arrangements for suppressing selected sidelobes where the arrangement comprises a main focusing reflector, a main feed arrangement and at least two auxiliary feed arrangements disposed on opposite sides of, and a predetermined equal distance from, the main feed arrangement in the plane of the sidelobes to be primarily suppressed. All feed arrangements radiate the same signal and their individual beams are radiated in a direction whereby the central ray thereof impinge the same point on the main reflector. By proper adjustment of the phase, amplitude and transverse off-axis distance of the auxiliary feed arrangements from the main feed arrangement, the combined E-field distribution of the auxiliary feed arrangements at the edge of the reflector in the plane of the far sidelobes to be suppressed will be equal and opposite to the E-field distribution of the main feed arrangement at the edge of the reflector.

It is an aspect of the present antenna arrangement to additionally provide near sidelobe suppression by either the appropriate shaping of each of the main reflector and subreflector in a dual reflector arrangement when the main feed arrangement is a single feed element or a subarray of feed elements, or by using a subarray of feed elements for the main feed arrangement and feeding each element with an appropriate separate amplitude and phase of the same signal, for causing perturbations in the energy density at appropriate points across the aperture of the main focusing reflector.

Other and further aspects of the present invention will become apparent during the course of the following description and by reference to the accompanying drawings.

BRIEF DESCRIPTION OF THE DRAWINGS

Referring now to the drawings, in which like numerals represent like parts in the several views.

DETAILED DESCRIPTION

The present invention is described hereinafter primarily in relation to a Cassegrain antenna arrangement. However, it will be understood that such description is exemplary only and is for purposes of exposition and not for purposes of limitation. It will be readily appreciated that the inventive concept described is equally applicable for use in other types of antenna arrangements, such as, for example, the Gregorian arrangement or just a main reflector, for suppressing sidelobes.

Figure 1:
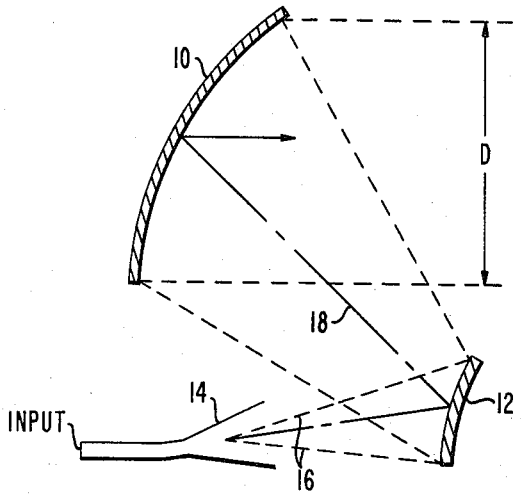
FIG. 1 (PRIOR ART)
FIG. 1 is an illustration of a known Cassegrain antenna arrangement.
Figure 2:
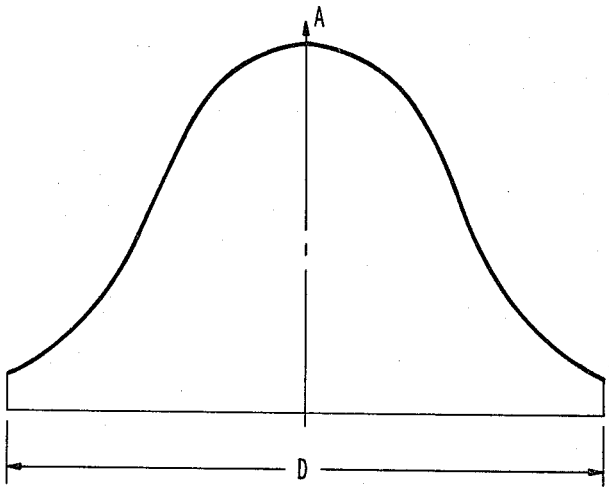
FIG. 2 (PRIOR ART)
FIG. 2 is a typical E-field distribution across the aperture of the main reflector of the antenna arrangement of FIG. 1 for producing low sidelobes.

FIG. 1 illustrates a known off-axis fed Cassegrain antenna arrangement comprising a main focusing parabolic reflector 10 having an aperture D, a hyperbolic subreflector 12 and a large main feed arrangement 14 such as a corregated feedhorn or a subarray of feed elements which is capable of launching a beam 16 having a central ray 18 for reflection by subreflector 12 and reflector 10 to aperture D. To achieve a beam of electromagnetic energy from the antenna arrangement of FIG. 1 comprising low, far off-axis, sidelobes, it is known that the E-field amplitude, A, at the edge of the aperture D of main reflector 10 should be relatively small compared to the E-field amplitude at the center of the aperture D. A typical E-field distribution as just described which can be obtained by the arrangement of FIG. 1 using a contemporary single antenna feed element is shown in FIG. 2. It is to be understood that a similar E-field distribution can also be obtained by a cluster of smaller feed elements (not shown) located in approximately the same region, and in place of, the single large element 14.

Although an E-field distribution as shown in FIG. 2 provides low, far off-axis, sidelobes, interference in other communication links can be caused by such sidelobes when, for example, received in adjacent or near proximate antennas associated with such other links. Such interference might be suppressed by the use of processing circuitry incorporated at the receivers of such other links as discussed hereinbefore in association with the prior art techniques. Alternatively, if the E-field amplitude, A, at the edges of the aperture of reflector 10 could be reduced, at least in the plane of an adjacent communication link, then interference would be reduced without the use of the prior art processing circuitry.

Figure 3:
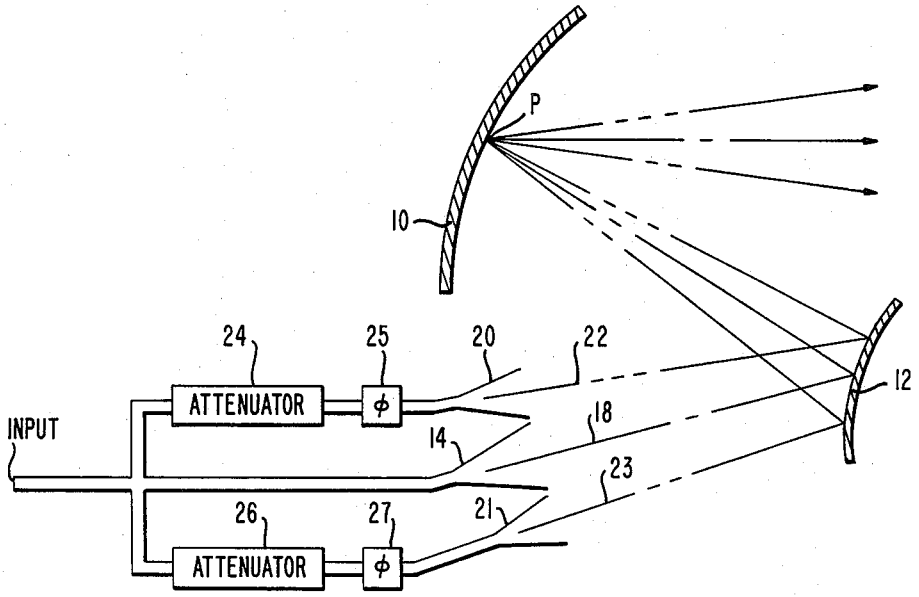
FIG. 3 illustrates the Cassegrain antenna arrangement of FIG. 1 which is modified in accordance with the present invention to further suppress sidelobes in a particular plane of radiation.

FIG. 3 illustrates an off-axis fed Cassegrain antenna arrangement, as shown in FIG. 1, which is modified in accordance with the present invention to substantially reduce any E-field amplitude at the edges of aperture D of main reflector 10 in the plane of the paper depicting FIG. 3. It is to be understood that sidelobes in other planes could also be suppressed by practicing the present inventive arrangements in other planes of interest. As shown in FIG. 3, to the main reflector 10, subreflector 12 and large main feed arrangement 14 there is added a first and a second auxiliary feed arrangement 20 and 21, respectively. First auxiliary feed arrangement 20 is disposed on one side of main feed arrangement 14 and second auxiliary feed arrangement 21 is disposed on the opposite side of feed arrangement 14 in the plane of the sidelobes to be primarily suppressed.

Auxiliary feed arrangements 20 and 21 are disposed such that a beam radiated by each of auxiliary feed arrangements 20 and 21 will cause a central ray 22 and 23, respectively, thereof to be reflected from subreflector 12 and impinge on the same point P on main reflector 10 as central ray 18 from main feed arrangement 14. In operation, an input signal to be radiated by the antenna arrangement is fed directly to main feed arrangement 14 and separate portions thereof are tapped off and fed via an antennuator 24 and phase shifter 25 to auxiliary feed arrangement 20, and an attenuator 26 and phase shifter 27 to auxiliary feed arrangement 21. Then by proper adjustment of the phase in phase shifters 25 and 27, the amplitude in attenuators 24 and 26, and the transverse off-axis distance of the auxiliary feed arrangements 20 and 21 from main feed arrangement 14, an auxiliary feed arrangement main reflector E-field amplitude distribution as shown by the dashed line in FIG. 4 can be obtained.

Figure 4:
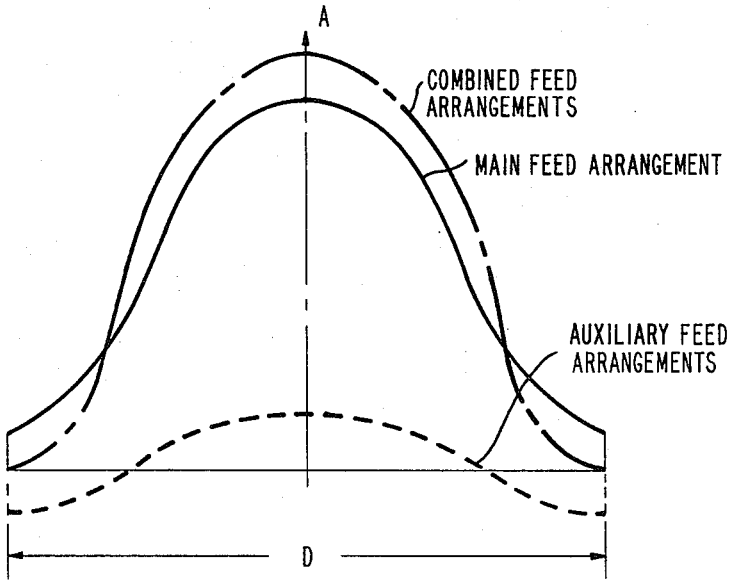
FIG. 4 is a typical E-field distribution across the aperture of the main reflector of the antenna arrangement of FIG. 3 produced by the auxiliary feed arrangements, the main feed arrangement and the combination of all feed arrangements.

In the auxiliary feed arrangement E-field amplitude distribution shown in FIG. 4 as a dashed line, the periodicity is caused by the phasing of the two beams from the two auxiliary feed arrangements 20 and 21. The truncation amplitudes at the aperture edges in the plane of the feed arrangements are similar in size but opposite in direction to those shown in FIG. 2 and repeated in FIG. 4 with the designation "Main Feed Arrangement". The superposition of the E-field distribution for the auxiliary feed arrangements 20 and 21 on the E-field distribution of the main feed arrangements 14 results in the net truncations which are essentially zero, as shown in the "combined feed arrangements" curve of FIG. 4, which is as needed to eliminate or at least obtain very low, far off-axis sidelobes.

In FIG. 4, the E-field amplitude, A, at the center of the distribution for auxiliary feed arrangements 20 and 21 is relatively small compared to the center of the distribution for main feed arrangement 14. Thus, the truncation cancellation produced at the edges of aperture D of main reflector 10 is achieved in accordance with the present invention by using only a small percentage of the total input feed power for transmissions by auxiliary feed arrangements 20 and 21. Additionally, the general shape of the original amplitude distribution of the antenna system, shown by the curve for main feed arrangement 14 in FIGS. 2 and 4, is not greatly changed by the superimposing of the amplitude distribution of both auxiliary feed arrangements 20 and 21 thereon resulting in the combined feed arrangements distribution shown in FIG. 4. Consequently, the width and the shape of the new main lobe from the antenna arrangement of FIG. 3 is not greatly changed from the original main lobe generated by the antenna arrangement of FIG. 1.

Since the spacings of the truncations of the main and auxiliary feed arrangements are the same, because all beams use the same main reflector 10, the cancellation process is broadband. More specifically, the far sidelobes due to the truncations of FIG. 2 are more or less equal and opposite to the truncations due to the combined distribution of auxiliary feed arrangements 20 and 21 shown in FIG. 4. Consequently, the equal and opposite sidelobes tend to experience the same changes in direction as a function of frequency, resulting in broadband cancellation.

By proper choice of the transverse off-axis spacing of the auxiliary feed arrangements 20 and 21 from feed arrangement 14, the slopes of the E-field distribution at the truncation points in FIG. 4 can be finite. By proper choice of these slopes, the net slopes after superposition of the E-field distribution of the auxiliary feed arrangements 20 and 21 upon the E-field distribution of main feed arrangement 14 can be zero at the edges of main reflector 10. That is, the auxiliary feed arrangements 20 and 21 can be used to control the slope as well as the amplitude of the E-field at the edge of main reflector 10. This degree of control is important in obtaining cancellation of specific sidelobes or groups of sidelobes.

As was stated hereinbefore, the E-field distributions shown in FIG. 4 for the main and auxiliary feed arrangements are for a cut through the main reflector 10, subreflector 12 and feed arrangements 14, 20 and 21 in the plane of the paper. Similar distributions can also be obtained for a similar cut through main reflector 10 in any other plane by locating auxiliary feed arrangements as outlined for auxiliary feed arrangements 20 and 21 adjacent main feed arrangement 14 in a plane approximately parallel to the new cut through reflector 10. In this manner, cancellation or selective suppression of far off-axis sidelobes can be achieved in any desired one or more directions from the main radiated lobe.

It is to be understood that the above-described embodiments are simply illustrative of the principles of the invention. Various other modifications and changes may be made by those skilled in the art which will embody the principles of the invention and fall within the spirit and scope thereof. For example, it is to be understood that additional auxiliary feed arrangements, with their associated attenuators and phase shifters as shown in FIG. 3 for auxiliary feed arrangements 20 and 21, can be placed adjacent auxiliary feed arrangements 20 and 21 and in the plane thereof. The use of more auxiliary feed arrangements directly provides greater flexibility in the choice of which sidelobes will be simultaneously cancelled primarily in the plane of the feed arrangements.

Figure 5:
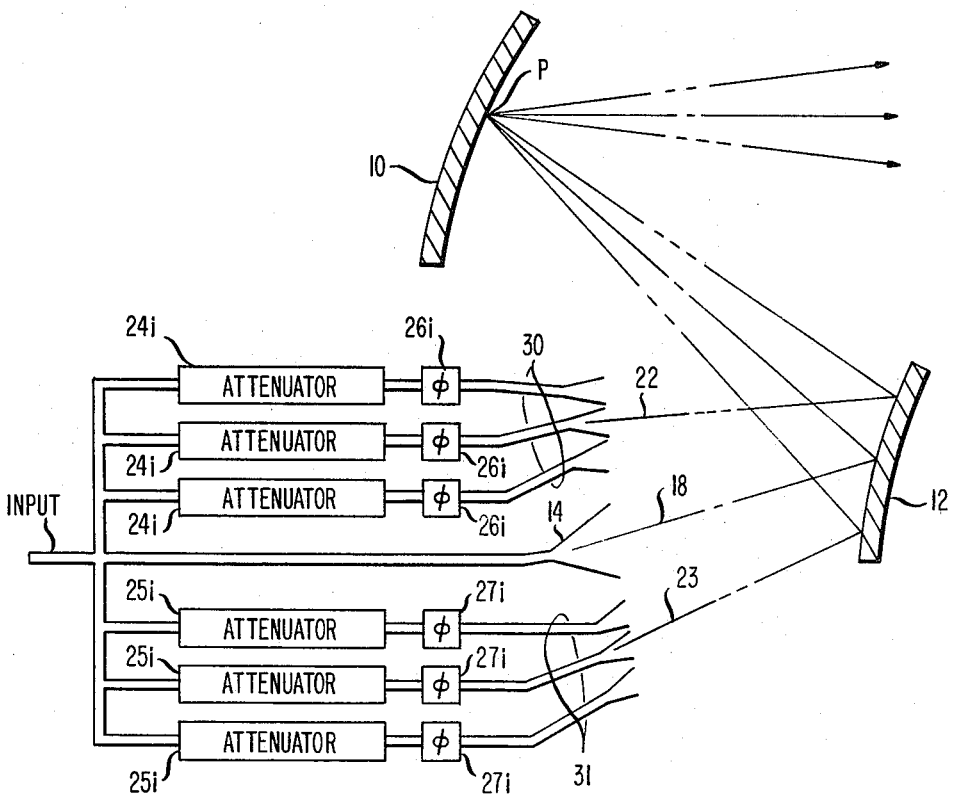
FIG. 5 is an alternative arrangement to that shown in FIG. 3.

It is to be understood that although the prior discussion has primarily concerned itself with the effect of auxiliary feed arrangements on sidelobes in the plane of the feed arrangements, the auxiliary feed arrangements also have some effect on sidelobes in other planes since each feed arrangement is effectively a point source and radiations therefrom phase to constructively add or substract with other feed arrangement radiations in all directions. Therefore, the effect on any sidelobe in any direction is dependent on the number and location of the feed arrangements and, in turn, on the vector addition of the distribution from all feeds to get an overall preferred amplitude distribution for cancellation or suppression of desired sidelobes even in directions not of major interest. It is to be further understood that a cluster of feed elements 30 and 31 as shown in FIG. 5 could form each of auxiliary feed arrangements 20 and 21 of FIG. 3 and under such arrangement the overall effect to cancel sidelobes in the primary and secondary directions can be evaluated by said aforementioned vector addition of all distributions. Each of the feed element of clusters 30 and 31 is shown as coupled to a separate attenuator 24*a* and 26*a*, respectively, and a separate phase shifter 25*a* and 27*i*, respectively, for illustrative purposes only. It is to be understood that certain of the attenuators or phase shifters could be combined or omitted if the values between them are the same or zero, respectively. In addition, by subdividing a main feed arrangement 14 into a subarray of feed elements, as mentioned hereinbefore, and by the proper choice of amplitude and phase of the signal being fed to each element of the subarray, the amplitude distribution associated with the main feed subarray radiation pattern across the aperture of main reflector 10 can be appropriately perturbed to cause a reduction of near sidelobes in addition to the far sidelobes. Alternatively, such latter amplitude distribution across the aperture of main reflector 10 can be achieved with a single main feed arrangement 14 by appropriately shaping subreflector 12 and main reflector 10 to alter the energy density at appropriate points across the aperture of main reflector 10 and thereby reduce the near sidelobes. Typical dual reflector shaping techniques for achieving various effects have been used for many years and are generally discussed in, for example, the article "Shaped Dual Reflector Synthesis" by R. Mittra et al in *IEEE Antennas and Propagation Society Newsletter,* Vol. 22, No. 4, Aug. 1980 at pp. 5–9.

I claim:

1. An antenna arrangement for suppressing selected sidelobes, the antenna comprising:

a main focusing reflector (10); and a first feed arrangement (14) disposed to permit radiation of a first beam of electromagnetic energy therefrom in a particular direction along a feed axis of the antenna arrangement such that a central ray of the first beam impinges a particular point (P) on the main focusing reflector characterized in that the antenna arrangement further comprises:

a second and a third feed arrangement (20, 21) disposed on opposite sides of, and a predetermined equal distance from the first feed arrangement and in a plane corresponding to the plane of the selected sidelobes to be suppressed, the second and third feed arrangement being capable of radiating a second and a third beam, respectively, of electromagnetic energy, comprising the same signal as transmitted in the first beam, in a direction to cause a central ray of the second and third beams to impinge the same particular point (P) on the main reflector as the central ray of the first beam; and means (24, 26) connected to the second and third feed arrangement for adjusting the amplitude and phase of a signal passing therethrough to cause the combined resultant E-field distribution of the second and third beams at the edge of the reflector in the plane of the feed arrangements to have an amplitude which is substantially equal and opposite to an E-field distribution of the first beam for reducing selected far sidelobes.

2. An antenna arrangement according to claim 1 characterized in that the first, second and third feed arrangements each comprise a separate single feed element.

3. An antenna arrangement according to claim 2 characterized in that the antenna arrangement further comprises:

a fourth and a fifth feed arrangement disposed adjacent to said second and third feed arrangements, respectively, on opposite sides of, and a predetermined second distance from, the first feed arrangement in said plane corresponding to the plane of the selected sidelobes to be cancelled, the fourth and fifth feed arrangements being capable of radiating a fourth and a fifth beam, respectively, of electromagnetic energy, comprising the same signal as transmitted in the first beam, in a direction to cause the central ray of the fourth and fifth beam to impinge the same particular point on the main reflector as the central ray of the first beam; and means connected to the fourth and fifth feed arrangements for adjusting the amplitude and phase of a signal passing therethrough to cause the combined resultant E-field distribution of the second, third, fourth and fifth beams at the edge of the reflector in the plane of the feed arrangements to have an amplitude which is substantially equal and opposite to an E-field distribution of the first beam for reducing selected far sidelobes.

4. An antenna arrangement according to claim 2 or 3 characterized in that the antenna arrangement further comprises:

a subreflector (12), where the subreflector and the main focusing reflector are appropriately shaped to cause perturbations in the energy density within the transmitted first beam at appropriate points across the aperture of the main focusing reflector for reducing near sidelobes.

5. An antenna arrangement according to claim 1 characterized in that the second and third feed arrangements each comprise a separate cluster of feed elements with each cluster being disposed on opposite sides of, and a predetermined equal distance from, the first feed arrangement and in a plane corresponding to the plane of the selected sidelobes to be suppressed, the first and second clusters being capable of radiating a second and a third beam, respectively, of electromagnetic energy, comprising the same signal as transmitted in the first beam, in a direction to cause a central ray of the second and third beams to impinge the same particular point on the main reflector as the central ray of the first beam and with an amplitude and phase to cause the combined resultant E-field distribution of the second and third beams at the edge of the reflector in the plane of the feed arrangements to have an amplitude which is substantially equal and opposite to an E-field distribution of the first beam for reducing selected far sidelobes.

6. An antenna arrangement according to claim 1 or 5 characterized in that the first feed arrangement comprises a subarray of a plurality of feed elements with each element being capable of being fed a signal with a separate amplitude and phase for causing the amplitude distribution of the first beam to be perturbed at points across the aperture of the main focusing reflector in a manner to cause a reduction in selected near sidelobes.

* * * * *